US006413031B1

(12) United States Patent
Yakley et al.

(10) Patent No.: US 6,413,031 B1
(45) Date of Patent: Jul. 2, 2002

(54) AUTOMATIC REFUSE CONTAINER LATCH

(75) Inventors: Bruce D. Yakley, Neenah; James C. White; Mark C. Wittak, both of Oshkosh; Andrew P. Desotell, Appleton, all of WI (US)

(73) Assignee: Leach Company, Oshkosh, WI (US)

( * ) Notice: Subject to any disclaimer, the term of this patent is extended or adjusted under 35 U.S.C. 154(b) by 0 days.

(21) Appl. No.: 09/824,128

(22) Filed: Apr. 2, 2001

(51) Int. Cl.[7] ..... B65F 3/04
(52) U.S. Cl. ..... 414/406; 414/408
(58) Field of Search ..... 414/406, 408

(56) References Cited

U.S. PATENT DOCUMENTS

| | | | | |
|---|---|---|---|---|
| 3,580,408 A | | 5/1971 | Newton | |
| 3,653,522 A | | 4/1972 | Gollnick | 214/83.3 |
| 3,679,077 A | | 7/1972 | Gennick | |
| 3,702,662 A | | 11/1972 | Davieau | |
| 4,050,594 A | | 9/1977 | Gollnick | 214/83.3 |
| 4,091,944 A | | 5/1978 | Gollnick | 214/302 |
| 4,260,316 A | | 4/1981 | Gollnick | 414/501 |
| 4,575,300 A | * | 3/1986 | George | 414/406 |
| 4,960,355 A | | 10/1990 | Worthington | |
| 5,425,613 A | | 6/1995 | Osborn | |
| 5,720,588 A | | 2/1998 | Graves | 414/406 |
| 6,261,046 B1 | | 7/2001 | Fryman | |

FOREIGN PATENT DOCUMENTS

| | | | |
|---|---|---|---|
| DE | 1 201 756 | | 9/1965 |
| JP | 2001-31204 | * | 2/2001 |

* cited by examiner

*Primary Examiner*—Steven A. Bratlie
(74) *Attorney, Agent, or Firm*—Cook, Alex, McFarron, Manzo, Cummings & Mehler, Ltd.

(57) ABSTRACT

An automatic refuse container latch that is adapted to receive one of the opposed, outwardly-extending portions of a trunnion for a refuse container in order to secure the refuse container to a refuse collection vehicle. The latch comprises a forward stop that is adapted to be secured to the refuse collection vehicle and which forms a part of a channel for slidingly receiving one of the outwardly extending portions of the trunnion. An elongated locking arm is provided that has first and second ends with a pivot connection intermediate the first and second ends. The pivot connection is slidingly secured to an elongated track. A piston actuator is provided comprising a cylinder and a rod, with the rod being movable between a retracted and an extended position. A locking ear is provided for capturing the second end of the locking arm.

4 Claims, 4 Drawing Sheets

AUTOMATIC REFUSE CONTAINER LATCH

BACKGROUND OF THE INVENTION

The present invention relates to refuse collection vehicles and, more particularly, to an improved automatic refuse container latch for securing a refuse container to the refuse collection vehicle during the emptying of the contents of the container into the vehicle.

Large refuse collection containers are commonly used in commercial and high density residential settings. Refuse collected in a container is typically transferred to a refuse collection vehicle by placing an upper edge of the container adjacent a loading edge or sill of the hopper of the refuse collection vehicle. The upper edge of the container includes a trunnion structure, about which the container is pivoted to tip the container so that the contents are discharged into the hopper. The tipping of the container is commonly accomplished with the aid of a lift mechanism, such as a push bar, winch/cable/hook combination, or reeving cylinder, which are well known.

For safety reasons, a pair of latch mechanisms is typically used to secure the container to the truck hopper adjacent the sill, each latch mechanism defining an enclosed slot that captures an outwardly-extending portion of the trunnion. Many latch mechanisms require that the container be positioned with respect to the truck so that the trunnion bar extensions are within the slot area to be closed by the latch. It can be difficult to so position the container, due to its weight and/or the unevenness of the surface supporting the container. These difficulties are exacerbated if the latch must be manually closed by the truck operator, as the operator may not have sufficient strength to close the latch and move the trunnion bar into the desired area.

Accordingly, it is the principle object of the present invention to provide an improved refuse container latch for use with a refuse collection truck.

More specifically, it is an object of the present invention to provide an automatic refuse container latch that safely and securely locks a container to the refuse collection vehicle and that is relatively simple in design and reliable in operation.

It is a further object to provide an automatic refuse container latch that is durable and able to withstand heavy use and abuse.

It is a still further object to provide an automatic refuse container latch that retracts to an out-of-the-way position when not in use.

SUMMARY OF THE INVENTION

These objects, as well as others that will become apparent upon reference to the following detailed description and the accompanying drawings, are accomplished by a refuse container latch that is adapted to receive one of the opposed, outwardly-extending portions of a trunnion for a refuse container in order to secure the refuse container to a refuse collection vehicle. The latch comprises a forward stop that is adapted to be secured to the refuse collection vehicle and which forms a part of a channel for slidingly receiving one of the outwardly-extending portions of the trunnion. An elongated track is provided which is secured to the refuse collection vehicle. An elongated locking arm is provided that has first and second ends, with a pivot connection intermediate the first and second ends. This pivot connection is slidingly secured to the elongated track. A piston actuator is provided comprising a hydraulic cylinder and a rod, with the rod being moved between a retracted and an extended position, one of the cylinder and the rod being adapted to be pivotally connected to the refuse collection vehicle and the other of the cylinder and rod being pivotally connected to the first end of the locking arm. A locking ear is provided for capturing the second end of the locking arm. Thus, when the rod moves from its retracted position to its extended position, the pivot connection first slides along the elongated track, the latching arm rotates about the pivot connection to capture one of the outwardly-extending portions of the trunnion and draw the trunnion into the channel. Simultaneously, the locking ear captures the second end of the latching arm to secure the trunnion and the channel.

In a preferred embodiment, the track comprises a pair of spaced-apart plates, each having a substantially identical elongated slot for receiving the pivot connection of the latching arm. The latching arm is located between the plates and the pivot connection comprises a transverse shaft that is captured in the slots of the two plates.

Additionally, a major portion of the slot or track, beginning with the first end, is generally horizontal, while a minor portion of the slot or track at the second end is generally vertical. Accordingly, the latching arm moves horizontally as the pivot connection travels from the first end of the slot along the major portion of the slot, then rotates about the pivot connection and moves vertically as the pivot connection travels along the minor portion of the slot to the second end of the slot, with the second end of the latching part simultaneously being captured by the locking ear as the pivot connection reaches the end of the minor portion of the slot.

DETAILED DESCRIPTION OF THE PREFERRED EMBODIMENTS

Figure 1:
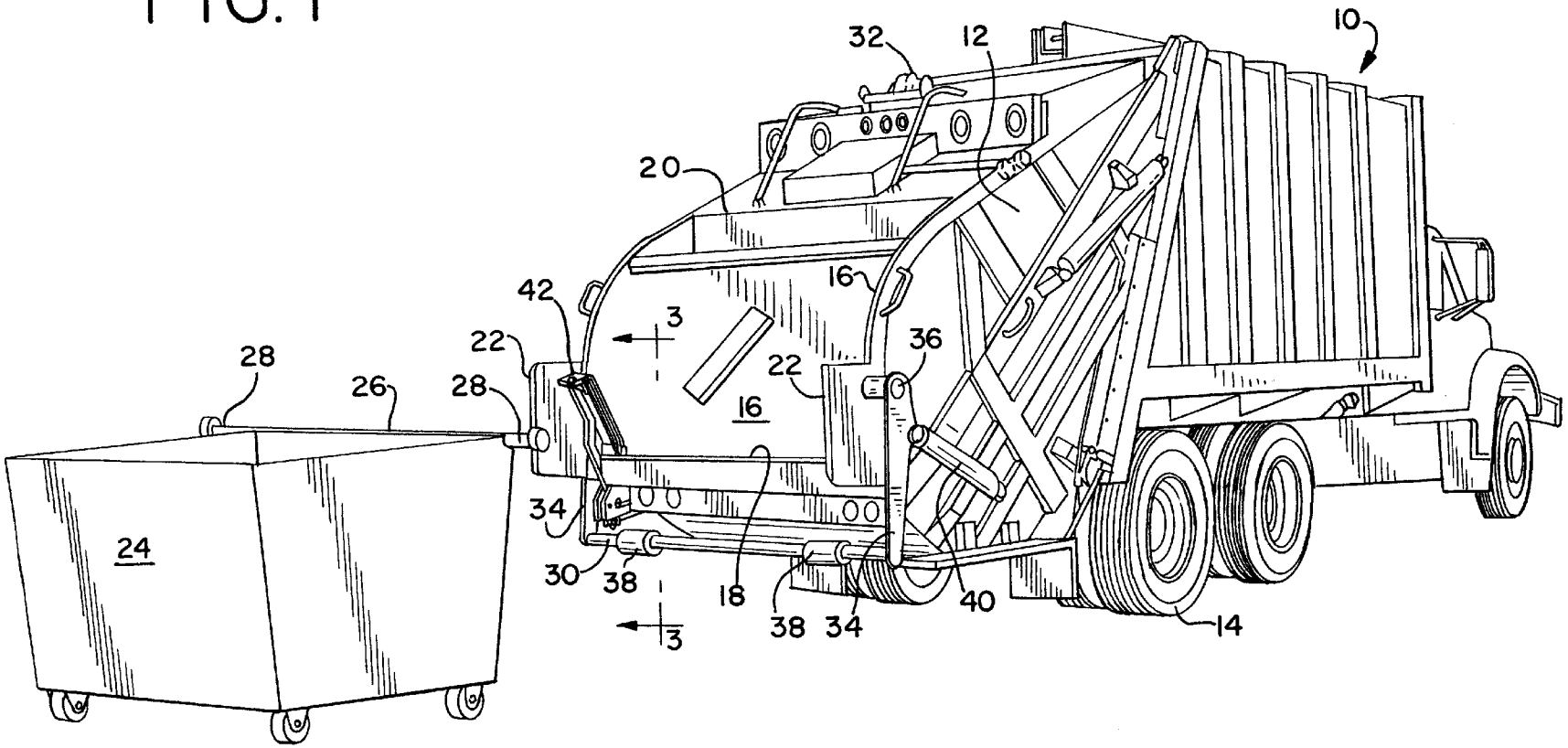
FIG. 1 is a perspective view of a rear hopper refuse collection truck and a refuse container.

Turning to the figures of the drawings, there is seen in FIG. 1 a perspective view of a rear hopper refuse collection truck, generally indicated by 10, with which an automated refuse container latch according to the present invention may be advantageously used. The truck 10 includes a hopper portion 12 depending from the truck generally rearward of the rear wheels 14 into which refuse is dumped for compaction. The hopper 12 includes a rearward-facing opening generally defined by sidewalls 16, a lower loading edge or sill 18, and an upper edge 20. Each sidewall 16 includes an extension or ear 22 adjacent the loading sill 18 that cooperates with the container latch to be described in detailed below.

Also shown in FIG. 1 is a rollable refuse container 24 having an open end including, on one side, a trunnion bar 26 that has a portion that laterally extends beyond each sidewall of the container, referred to herein as the container arms 28. The trunnion bar 26 of the container is typically between 1¼ inches to 1¾ inches in diameter and between 77½ inches and 78 inches from end-to-end.

As is well known, to empty the container 24 of its contents, the container is positioned with the trunnion bar 26 adjacent the loading edge 18 of the hopper, with the container arms 28 between the sidewall extensions 22. The container arms 28 are then secured to the hopper 12 and the container 24 is then pivoted about the trunnion 26 by means of e.g., a hydraulically-actuated container push bar 30 (also called a tipper bar or kick bar), a drum winch 32 having a cable and hook (not shown), or a reeving cylinder 33. The container push bar 30 includes support arms 34 that are pivotally connected to the hopper sidewall 16 by means of posts 36. The push bar 30 may include lift pads 38 to prevent damage to the container when engaged by the push bar. A dumping cylinder 40 moves the push bar 30 to dump the contents of the refuse container 24.

Figure 2:
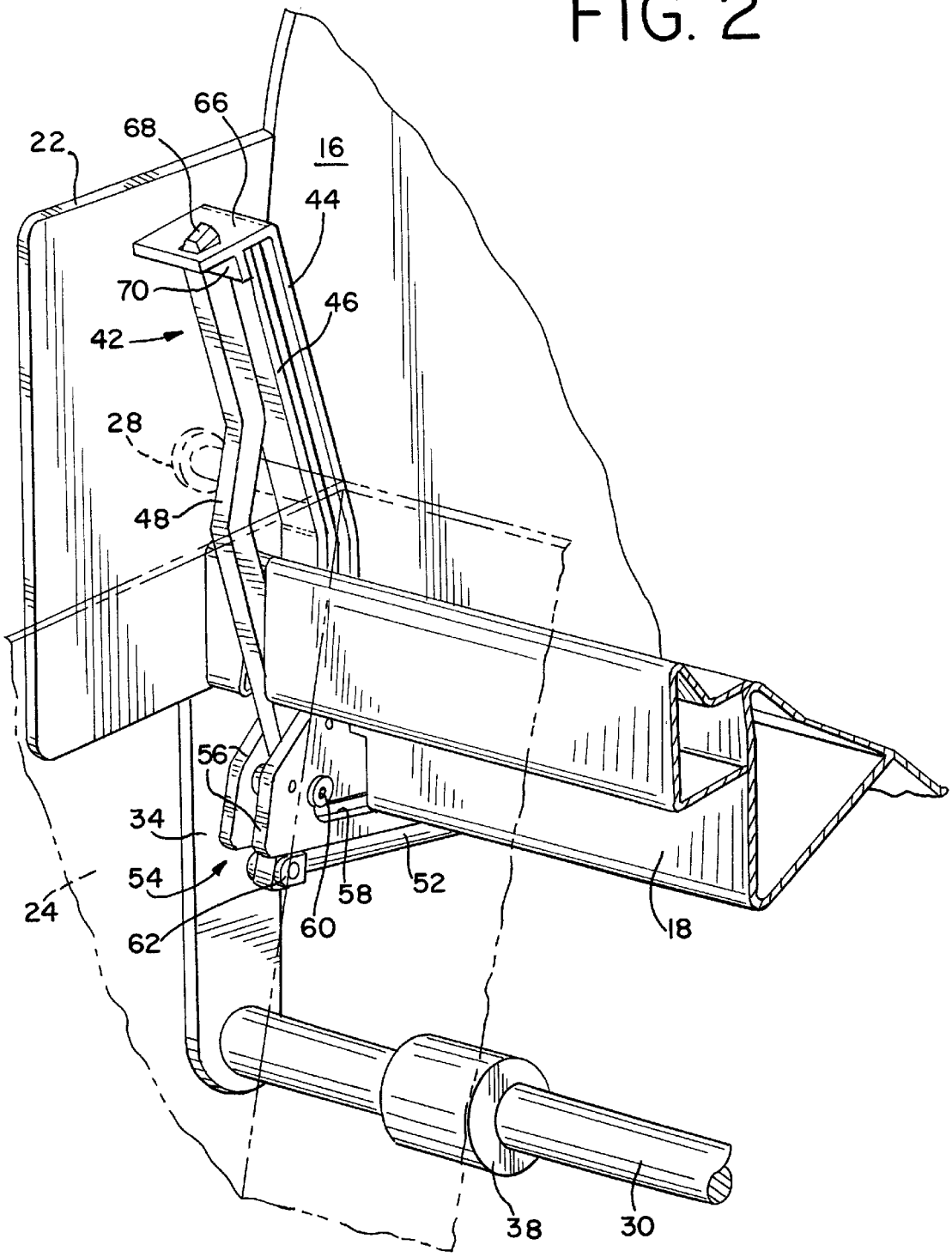
FIG. 2 is an enlarged fragmentary perspective view of a portion of the refuse collection truck of FIG. 1 showing an automated refuse container latch according to the present invention.
Figure 3:
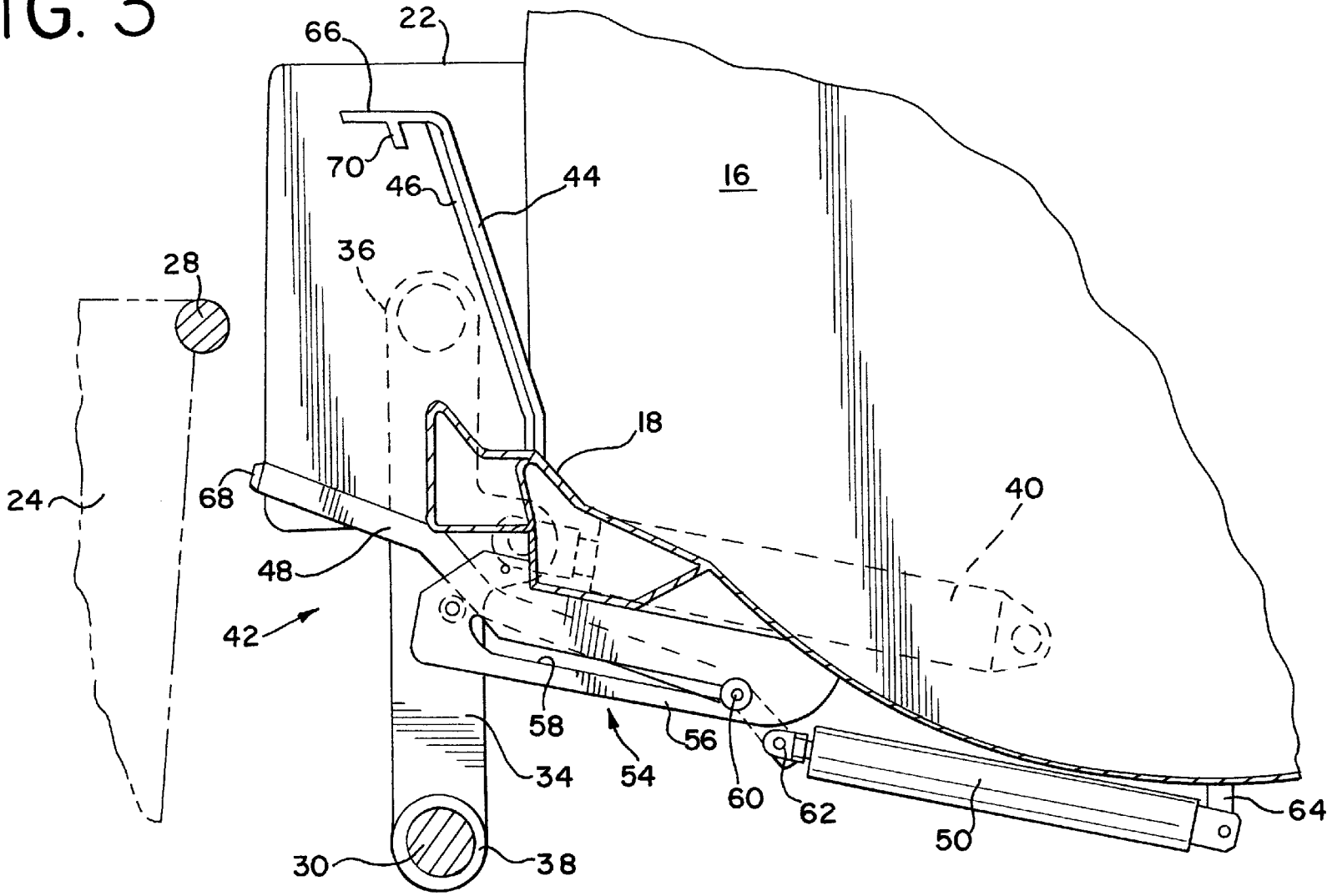
FIG. 3 is a side view of the automated refuse container latch of FIG. 2, showing the latch in its retracted position.
Figure 4:
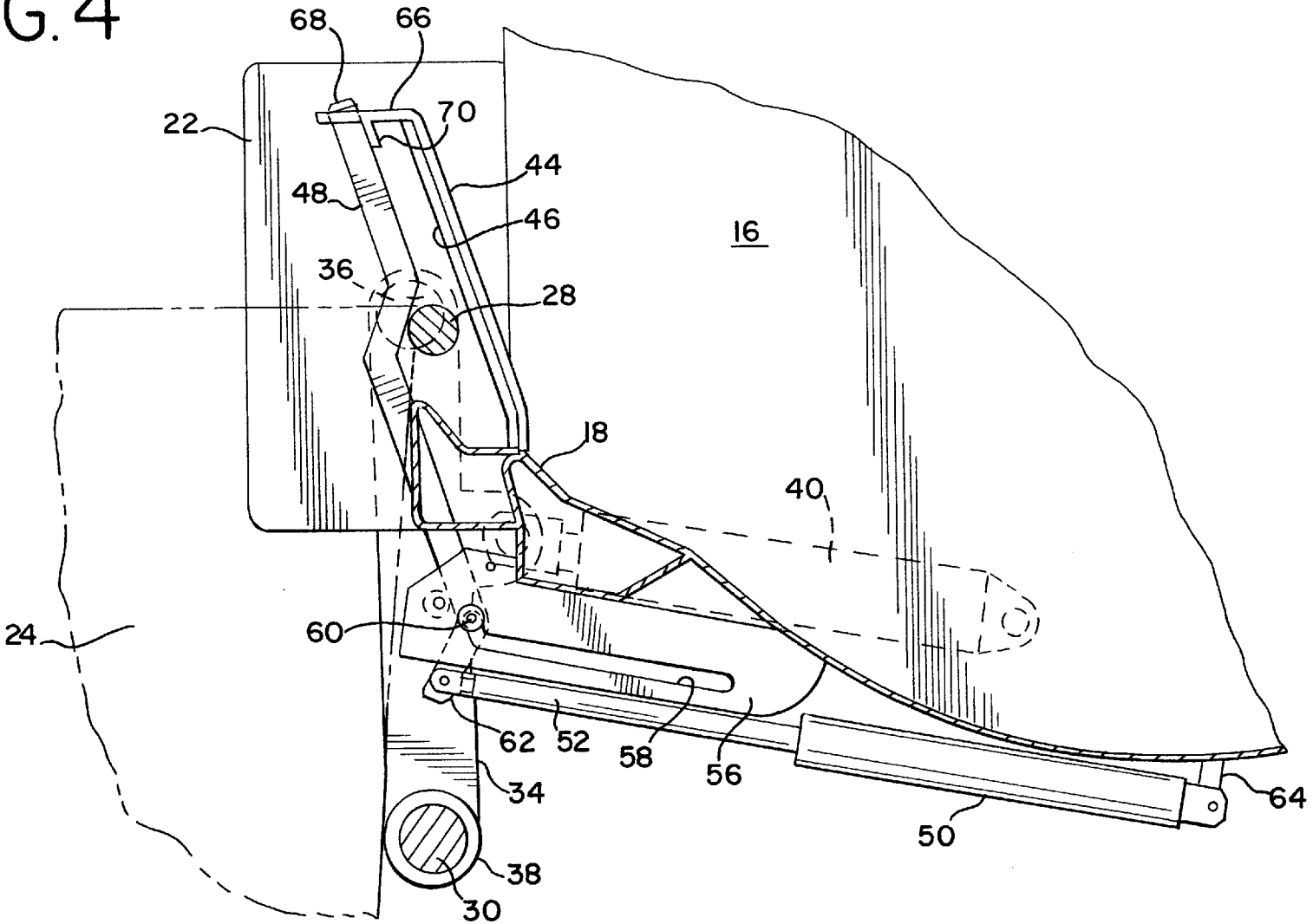
FIG. 4 is a side view of the automated refuse container latch similar to FIG. 3, except that the latch is in the extended or locked position.

In keeping with the invention, a hydraulically-actuated refuse container latch, generally designated 42, is provided at each side of the hopper 12 to form a pocket or channel that securely captures the container arms 28 of the container 24. As best seen in FIGS. 2–4, the refuse container latch 42 includes a forward stop 44 made of, e.g., forged steel which is secured by welding to the loading sill 18 and sidewall extension 22. (While only one container latch 42 is shown, it is understood that a container latch is located at each end of the loading sill 18 so that both container arms 28 are securely held prior to tipping the container 24.) The forward stop 44 may be provided with a reinforcing member 46 of, e.g., square bar stock, on its aft side. Forward stop 44 limits the forward movement of the container arms 28, and thus the container 24, into the hopper 12, while the sidewall extensions 22 prevent excessive movement of a container 24 in a direction lateral to the refuse collection truck 10.

An elongated locking arm 48 is provided that cooperates with the forward stop 44 and sidewall extension 22 to close the pocket or channel after the container arm 28 is located therein. The locking arm 48 is movable by means of an hydraulically-actuated piston cylinder 50 and piston rod 52 between a retracted position (FIG. 3) that is substantially out-of-the-way under the loading sill 18 to an extended, locking position (FIG. 4). To this end, the locking arm 48 is mounted for both pivoting and sliding motion to a generally elongated track 54 secured to the bottom of the hopper 12 and/or loading sill 18. As illustrated, the track 54 includes two substantially-identical, spaced-apart plate members 56, each having an elongated slot 58. The locking arm 48 is disposed between the two plates 56 and includes a transverse shaft 60 intermediate its two ends that is sized to be captured in the slots 58 of the plate members 56. The shaft 60 is able to both pivot with respect to the plate members 56 and travel along the length of the slot 58, thus providing for both linear and rotatory motion of the locking arm 48.

To move the locking arm 48 from the retracted position to the extended position, one end of the locking arm 48 is pivotally secured by a clevis 62 to the piston rod 52, the piston cylinder 50 being pivotally mounted to a bracket 64 secured to the underside of the hopper 12. When in the extended or locked position, the other end of the locking arm 48 is received in a locking ear 66. As illustrated, the locking ear 66 is formed integrally with the forwarded stop 44 and includes an aperture for receiving the end of the locking arm 48. To facilitate the entry of the locking arm 48 into the aperture, the end of the locking arm 48 may be beveled, as shown at 68 in FIG. 2. The locking ear 66 may also include a reinforcing member 70, which can be positioned to guide the beveled end 68 of the locking arm 48 toward the aperture in the locking ear.

The track 54 is designed so that the locking arm 48 moves first generally horizontally along a major portion of the slot 58 from its retracted position to an intermediate position. In this intermediate position, the beveled end 68 of the locking arm 48 is aft of the locking ear 66 and the container arms 28 of a container 24. The locking arm 48 then pivots about the shaft 60 in a clockwise direction (as illustrated) to capture the container arm 28 and draw it toward the forward stop 44. The locking arm 48 then moves generally vertically along a minor portion of the lock so that the beveled end 68 of the locking arm 48 passes through the aperture in the locking ear 66 to close the channel, thus capturing the arm 28 of the trunnion bar 26. This action is reversed to release the container arms 28 upon retraction of the locking arm 48.

As can be appreciated, the hydraulic pistons for the locking arms can be controlled in a manner well known in the art, with the extension and retraction of both locking arms preferably occurring simultaneously. To further enhance operator safety, the controls for the push bar or winch 32 can also be configured so that the locking arms must first be in their extended, latched position capturing the trunnion bar before the push bar or winch can be operated.

Thus, an automated refuse container latch achieving all the objects of the present invention has been provided. While the latch has been described in terms of a preferred embodiment, there is no intention to limit the invention to the same. Instead, the invention is defined by the following claims.

What is claimed is:

1. A refuse container latch for securing a refuse container having an trunnion with opposed, outwardly-extending portions to a refuse collection vehicle, the latch comprising:

a forward stop adapted to be secured to the refuse collection vehicle and forming a part of a channel for slidingly receiving one of the outwardly-extending portions of the trunnion;

an elongated track having a first and second end adapted to be secured to the refuse collection vehicle;

an elongated locking arm having first and second ends with a pivot connection intermediate the first and second ends slidingly secured to the elongated track;

a piston actuator comprising a cylinder and a rod, the rod being movable between a retracted and an extended position, one of the cylinder and the rod being adapted to be pivotally connected to the refuse collection vehicle and the other of the cylinder and rod being pivotally connected to the first end of the locking arm; and a locking ear for capturing the second end of the locking arm, whereby, when the rod moves from the retracted to the extended position, the pivot connection first slides along the elongated track from the first end to the second end and, upon the pivot connection reaching the second end of the track, the locking arm rotates about the pivot connection to capture one of the outwardly-extending portions of the trunnion to draw the refuse container trunnion into the channel, the locking ear simultaneously capturing the second end of the locking arm to secure the trunnion in the channel.

2. The refuse container latch of claim 1, wherein the track comprises a pair of spaced-apart plates, each having substantially identical elongated slots for receiving the pivot connection of the locking arm, the locking arm being located between the plates and the pivot connection comprises a transverse shaft that is captured in the slots of the plates.

3. The refuse container latch of claim 1, wherein a major portion of the track beginning with the first end is generally horizontal and a minor portion of the track at the second end is generally vertical so that, as the rod moves from the retracted to the extended position, the locking arm moves first linearly as the pivot connection travels from the first end of the track along a major portion thereof, the locking arm then rotating about the pivot connection and then moving linearly as the pivot connection travels along the minor portion of the track to the second end thereof, the second end of the locking arm being captured by the locking ear as the pivot connection moves along the minor portion of the track.

4. The refuse container latch of claim 2, wherein a major portion of the slots, beginning with the first end, is generally horizontal and a minor portion of the slots, at the second end, is generally vertical, so that, as the rod moves from the retracted to the extended position, the locking arm moves linearly as the pivot connection travels from the first end of the slots along the major portion of the slots, then rotates about the pivot connection, and then moves linearly as the pivot connection moves along the minor portion of the slots to the second end thereof, the second end of the locking arm being captured by the locking ear as the pivot connection moves along the minor portion of the slots.

* * * * *

UNITED STATES PATENT AND TRADEMARK OFFICE

CERTIFICATE OF CORRECTION

PATENT NO. : 6,413,031 B1 
DATED : July 2, 2002
INVENTOR(S) : Bruce D. Yakley, Mark A. Wittak, James C. White and Andrew P. Desotell It is certified that error appears in the above-identified patent and that said Letters Patent is hereby corrected as shown below:

Title page,
Item [75], Inventors, delete "C." and add -- A. --.

Signed and Sealed this

Third Day of September, 2002

*Attest:*

*Attesting Officer*

JAMES E. ROGAN
*Director of the United States Patent and Trademark Office*